US012366151B2

(12) United States Patent
Keyes et al.

(10) Patent No.: US 12,366,151 B2
(45) **Date of Patent: *Jul. 22, 2025**

(54) PENETRATOR AND DISPENSERS AND METHODS OF USE

(71) Applicant: Defiant Engineering, LLC, Odessa, TX (US)

(72) Inventors: Cullen Craig Keyes, Hysham, MT (US); Lawrence Gene Griffin, Morrison, CO (US); Ian Graham Janke, Parkland County (CA)

(73) Assignee: Defiant Engineering, LLC, Odessa, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/652,663

(22) Filed: May 1, 2024

(65) Prior Publication Data

US 2024/0287886 A1 Aug. 29, 2024

Related U.S. Application Data

(63) Continuation of application No. 18/456,003, filed on Aug. 25, 2023, now Pat. No. 12,006,808.

(Continued)

(51) Int. Cl.

*E21B 43/263* (2006.01)
*E21B 43/116* (2006.01)

(Continued)

(52) U.S. Cl.

CPC ..... *E21B 43/263* (2013.01); *E21B 43/116* (2013.01); *E21B 43/118* (2013.01); *E21B 43/1185* (2013.01)

(58) Field of Classification Search

CPC ..... F42B 12/06; E21B 43/117; E21B 43/116; E21B 43/263; E21B 43/1185; E21B 43/118

See application file for complete search history.

(56) References Cited

U.S. PATENT DOCUMENTS 2,169,671 A * 8/1939 Walker ..... F42D 1/05 175/4.55
2,456,977 A * 12/1948 McCullough ..... E21B 43/116 102/438

(Continued)

FOREIGN PATENT DOCUMENTS

CN 115704290 A 2/2023
WO 2017/171692 A2 10/2017

OTHER PUBLICATIONS

International Search Report and Written Opinion received for PCT Patent Application No. PCT/US23/72993, mailed on Jan. 30, 2024, 10 pages.

*Primary Examiner* — Daniel P Stephenson
(74) *Attorney, Agent, or Firm* — Workman Nydegger

(57) ABSTRACT

A dispenser includes a body that defines a chamber and a barrel that communicate with each other, and a penetrator assembly configured to be received in the chamber. The penetrator assembly includes a penetrator, a propellant operably positioned with respect to the penetrator, a primer in operable communication with the propellant, and an electrical conductor configured and arranged to carry electrical power to the primer. The dispenser may be positioned in a downhole location such as a wellbore, and the penetrator assembly may be fired so that the penetrator perforates a casing in the wellbore.

33 Claims, 11 Drawing Sheets

SECTION A-A

Related U.S. Application Data

(60) Provisional application No. 63/373,810, filed on Aug. 29, 2022.

(51) Int. Cl.
*E21B 43/118* (2006.01)
*E21B 43/1185* (2006.01)

(56) References Cited

U.S. PATENT DOCUMENTS

| | | | | | |
|---|---|---|---|---|---|
| 2,530,833 | A * | 11/1950 | Martin | E21B 43/116 175/4.58 |
| 2,530,834 | A * | 11/1950 | Martin | E21B 43/116 175/4.58 |
| 2,695,665 | A * | 11/1954 | Box | E21B 43/116 175/4.58 |
| 2,843,041 | A * | 7/1958 | Stewart | E21B 43/116 175/3.5 |
| 3,209,650 | A * | 10/1965 | Andrew | F42C 9/10 175/3.5 |
| 3,376,375 | A * | 4/1968 | Porter | E21B 43/116 175/4.58 |
| 6,467,387 | B1 * | 10/2002 | Espinosa | E21B 47/01 102/326 |
| 10,883,329 | B2 * | 1/2021 | Tøndel | E21B 29/02 |
| 12,006,808 | B2 * | 6/2024 | Keyes | E21B 43/1185 |
| 2013/0056212 | A1 | 3/2013 | Sampson | |
| 2020/0270973 | A1 | 8/2020 | Baumann et al. | |
| 2020/0392821 | A1 | 12/2020 | Eitschberger et al. | |
| 2022/0010660 | A1 | 1/2022 | Dyess et al. | |
| 2022/0205343 | A1 | 6/2022 | Fripp et al. | |
| 2024/0068346 | A1 | 2/2024 | Keyes et al. | |
| 2024/0287886 | A1 * | 8/2024 | Keyes | E21B 43/118 |

* cited by examiner

PENETRATOR AND DISPENSERS AND METHODS OF USE

FIELD OF THE INVENTION

Embodiments of the invention generally relate to downhole systems, components, and methods. One or more particular embodiments are directed to devices and methods for dispensing explosive charges in connection with downhole operations such as frac'ing.

BACKGROUND

During a conventional hydraulic fracturing process, a perforating gun, setting tool, and plug are run into the wellbore. This specific assembly is tethered to wireline and pumped down the wellbore. Once the assembly reaches its predetermined destination, the plug is set and sealed into the wellbore casing by the setting tool. Wireline will then begin pulling the perforating gun and setting tool out of the wellbore and begin firing highly explosive shaped charges into the wellbore casing, in turn creating perforations within about two hundred feet of the recently set plug.

The perforating gun may comprise multiple sub-assemblies, or 'subs,' that are connected to each other. Each sub may be between a foot or two in length and carry up to three to six shaped charges per sub. Over a two hundred foot perforation zone downhole, also known as a stage, there may be anywhere between thirty and sixty perforations. This means that each stage of a frac may require multiple perforating gun subs which, when connected together, may form an assembly up to thirty feet in length.

With conventional processes and equipment, once a shaped charge is fired from an existing perforating gun, power to any tool below, that is, downhole of, that fired shaped charge is no longer available due to damage from the exploding charge. As well, the shaped charge, once fired, destroys everything internal to the perforating gun sub. Thus, a perforating gun sub is not reusable once one or more of its charges have been fired.

BRIEF DESCRIPTION OF THE DRAWINGS

In order to describe the manner in which at least some of the advantages and features of the invention may be obtained, a more particular description of embodiments of the invention will be rendered by reference to specific embodiments thereof which are illustrated in the appended drawings. Understanding that these drawings depict only typical embodiments of the invention and are not therefore to be considered to be limiting of its scope, embodiments of the invention will be described and explained with additional specificity and detail through the use of the accompanying drawings.

DETAILED DESCRIPTION OF SOME EXAMPLE EMBODIMENTS

Figure 1:
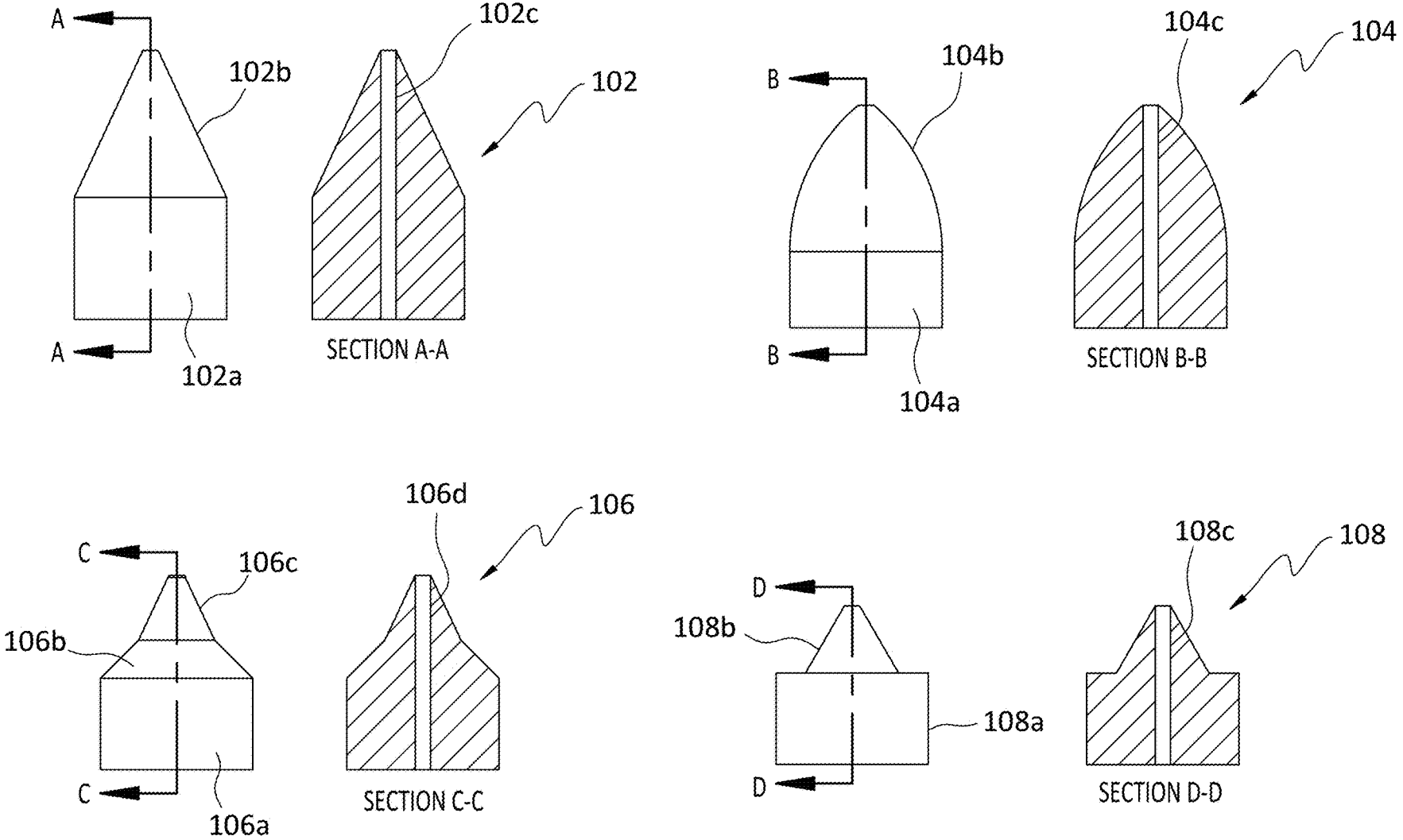
FIG. 1 discloses aspects of some example penetrators.

Embodiments of the invention generally relate to downhole systems, components, and methods. One or more particular embodiments are directed to devices and methods for dispensing explosive charges in connection with downhole operations such as frac'ing. Such devices may include, but are not limited to, perf guns, and other dispensers, and associated explosive charges, including penetrators in the form of shaped charges for example.

One example embodiment comprises a dispenser configured to carry one or more penetrators, such as to one or more downhole locations for example. The dispenser may take the form of a component that is separate from, but configured to interface with, a perf gun, or may be integrated into the perf gun as an element of the perf gun. In an embodiment, a dispenser may be used instead of a perf gun. In an embodiment, a penetrator assembly may comprise various elements such as a firing power wire, penetrator, propellant, and a primer. In an embodiment, a penetrator may be made of various materials, which may comprise high molecular weight materials. In an embodiment, a penetrator assembly may be loaded, as a single complete unit, into a dispenser chamber barrel of a dispenser. The type of penetrator assembly, and penetrator, may vary depending on such as considerations as downhole conditions, and the operation(s) to be performed downhole. In an embodiment, different types of penetrator assemblies may be deployed together in a single dispenser. In an embodiment, a penetrator may be disposed at various different orientations within a dispenser.

In an embodiment, when a dispenser with a penetrator assembly is in position downhole, the penetrator assembly may be fired by providing an electrical current to the firing power wire. The penetrator, after firing of the associated penetrator assembly, may create various sizes and types of openings in a well casing and a formation in which the dispenser is deployed. In an embodiment, multiple penetrator assemblies of a dispenser may fired in series, or all together at the same time, and/or in any other way. In an embodiment, the dispenser may be configured such that firing of one or more penetrator assemblies in the dispenser does not cause any material damage to the dispenser, such that the dispenser may be reloaded with one or more penetrator assemblies and used again.

Embodiments of the invention, such as the examples disclosed herein, may be beneficial in a variety of respects. For example, and as will be apparent from the present disclosure, one or more embodiments of the invention may provide one or more advantageous and unexpected effects, in any combination, some examples of which are set forth below. It should be noted that such effects are neither intended, nor should be construed, to limit the scope of the claimed invention in any way. It should further be noted that nothing herein should be construed as constituting an essential or indispensable element of any invention or embodiment. Rather, various aspects of the disclosed embodiments may be combined in a variety of ways so as to define yet further embodiments. For example, any element(s) of any embodiment may be combined with any element(s) of any other embodiment, to define still further embodiments. Such further embodiments are considered as being within the scope of this disclosure. As well, none of the embodiments embraced within the scope of this disclosure should be construed as resolving, or being limited to the resolution of, any particular problem(s). Nor should any such embodiments be construed to implement, or be limited to implementation of, any particular technical effect(s) or solution(s). Finally, it is not required that any embodiment implement any of the advantageous and unexpected effects disclosed herein.

For example, one advantageous aspect of an embodiment is that a dispenser may be configured such that it may be used for multiple operations, and is not materially damaged or destroyed by the firing of one or more penetrator assemblies. As another example, one or more embodiments may provide penetrators of various different geometries for achievement of different respective effects. Various other advantages of one or more example embodiments will be apparent from this disclosure.

A. Overview of Aspects of an Example Embodiment

An embodiment may comprise a dispenser that may be used in place of, or in addition to, of a conventional perforating gun. The dispenser may be made of various materials including, but not limited to, 4330 Vanadium Modified and 4340 and 4340 Vanadium Modified.

A dispenser may have a length of, for example, about 25 inches to 50 inches. One example dispenser may be less than 60" long and may be configured to contain as many as 70 penetrator assemblies each comprising a respective penetrator that may be used to penetrate, or perforate, a wellbore casing or other tubular member, and/or a formation. Other embodiments of a dispenser may be configured to carry more, or fewer, penetrator assemblies. Due to the structure and/or operation of the penetrator assembly and/or of the dispenser, once a penetrator assembly is fired, power may still be available downhole of the dispenser, and communication to tools or other penetrators positioned downhole of the recently dispensed penetrator may be maintained even after the firing of the penetrator assembly.

Penetrators, or other projectiles, according to one or more embodiments of the invention may be made of various materials. Example penetrator materials for one or more embodiments include, but are not limited to, tungsten, depleted uranium, steel, titanium, antimony, zinc, tin, copper, lead, rhenium, platinum, iridium, osmium, and any combination of these.

In an embodiment, the penetrators may be fired, otherwise projected, out of the dispenser through the use of an electrical or mechanical primer igniting a controlled burn, or rapid, burn, of propellant of the penetrator assembly. The burning propellant may in turn create gas that propels the penetrator out of the dispenser. The gas may be pressurized by virtue of the geometry of the dispenser and/or the geometry of the penetrator assembly, which may serve to contain, and direct, the gas in such a way that the gas exerts pressure on the penetrator, causing the penetrator to be propelled out of the dispenser.

In one example embodiment, a penetrator assembly may comprise a firing power wire, a penetrator, a propellant, and a primer. This assembly may be designed, manufactured, and packaged together as a single unit. In an embodiment, the firing power wire may pass through the center, or off center, of the penetrator, through the propellant and to and electric or mechanical primer. The firing power wire may also pass around the penetrator and through the propellant and directly to an electrical or mechanical primer.

In an embodiment, a penetrator assembly may be loaded, as a single unit, into a dispenser and pressed into a chamber barrel, or simply 'barrel,' of the dispenser. Once the penetrator assembly is thus positioned, the firing power wire may pass out the top of the barrel and to a bulkhead (a sealed electrical connector that is mechanical and creates a sealed barrier between two modules or downhole tools), connector, or directly to a penetrator firing board, which may comprise a PCB (printed circuit board). The penetrator firing board may control when, and where, the penetrator is fired into the wellbore casing, or wellbore tubular member. In an embodiment, the penetrator firing board may receive a signal, or command, from a master control board, or be contained within the master control board.

In an embodiment, the particular type and geometry of penetrator, and propellant, employed may depend upon downhole characteristics and conditions. For example, in one embodiment, a penetrator may be configured so that when fired from a dispenser, the penetrator creates an elliptically shaped hole in a wellbore casing and/or a formation, such as rock. Further, a penetrator with this configuration may act as a wedge in the rock to promote a fracture at lower breakdown pressure, while also maximizing the flow area of the fracture, and minimizing reductions in the strength of the casing through which the penetrator may partially, or completely, pass.

As another example, a penetrator according to an embodiment may be configured so that when fired from a dispenser, the penetrator creates an oval shaped hole in a wellbore casing and/or a formation, such as rock. Further, a penetrator with this configuration may act as a wedge in the rock to promote a fracture at lower breakdown pressure, while also maximizing the flow area of the fracture, and minimizing reductions in the strength of the casing through which the penetrator may partially, or completely, pass.

A penetrator according to another embodiment may be configured to create a smooth round hole that may serve as an orifice to allow precise calculation of fluid flow volumes and flow rates through the perforation. In this way, the flow through each perforation may be designed and controlled.

As a final example, a penetrator according to still another embodiment of the invention may have a geometry that causes, or facilitates, travel of the penetrator at a particular angle and/or path after the penetrator is fired. To illustrate, a penetrator and/or the dispenser may be configured such that when the penetrator comes into contact with the casing, or any hard surface, after the penetrator assembly is fired, the penetrator turns at a particular angle, such as about 45 degrees for example, and continues to penetrate the casing, formation, and/or other structure(s) at that angle. Further, the angled path, that is, angled relative to a radial or longitudinal axis of a wellbore casing, traveled by a penetrator may reduce perforation friction and erosion.

It should be understood that different penetrator/dispenser implementations may nonetheless share common configurations and elements, such as explosive types, propellants, and materials, and penetrator geometries, for example. Thus, unless an element or configuration is specifically identified as being for use only with specific penetrator/dispenser type(s), it should be understood that such element and configuration may be employed in other penetrator/dispenser implementations as well.

B. Example Embodiments of Penetrators

With attention now to FIG. 1, various example penetrator geometries are disclosed. For optimal penetration and hole geometries, example dispenser penetrator geometries according to some embodiments may be important for some operations. The penetrator geometries may make smooth and consistent hole sizes allowing for reduced friction loss across the hole during operations such as frac'ing for example. In one embodiment, a penetrator may be in the range of 0.5" long to 1.00" long.

B.1 Straight Edged Penetrator (SEP)

One example embodiment of an SEP is referenced at 102 in FIG. 1. As shown, the SEP 102 may comprise a generally cylindrical portion 102*a*, and a generally conical portion 102*b*. The cylindrical portion 102*a* and the conical portion 102*b* may be integral with each other and collectively formed of a single piece of material. The SEP 102 may define a passageway 102*c* into, and/or through, which a wire and/or other components may extend/pass.

In more detail, the SEP 102 may be made in solid form from a material, or a combination of materials, such as those disclosed herein. A solid SEP may be machined, compressed, cast, molded, extruded, or printed. In an embodiment, the SEP 102 may have an outside diameter of about, for example, 0.450", 0.500", or 0.550." As noted above, the SEP 102 may comprise a passageway 102*c* that extends through part or all of the SEP 102. In an embodiment, the passageway 102*c* may have a generally circular cross section, with an inside diameter of about 1/16", 1/8", or 1/4" for example. The passageway 102*c* may be sized and configured to enable a wire to pass through the SEP 102 and connect to an electric or mechanical primer located beneath the SEP 102. In an embodiment, the passageway 102*c* may hold various materials. Such materials may include, but are not limited to, a propellant, or combustible material, element, or chemical, that may reside or be conformed to the inside diameter of passageway 102*c*.

One or more embodiments of the SEP 102 may be made from materials such as, but not limited to, tungsten alloys including molybdenum tungsten, niobium tungsten, vanadium tungsten, and cemented carbide or tungsten carbide. The tungsten may contain elements such as, but not limited to, copper, cobalt, nickel, iron, and chromium. Other example materials for the SEP 102 according to an embodiment include, but are not limited to, depleted uranium, uranium 238, materials including steel, titanium, antimony, zinc, tin, copper, lead, rhenium, platinum, iridium, and osmium, and any combination of these.

In an embodiment, the SEP 102 may also comprise an outer shell, or jacket, that may be made from any of the aforementioned SEP 102 materials, or combinations thereof. The outer shell or jacket may be separated from, or integral with, the cylindrical portion 102*a* and/or the conical portion 102*b*.

In an embodiment, a jacket (see FIG. 5) may be filled with a material, or a combination of materials, such as those disclosed herein for penetrators. The jacket may be formed in various ways. For example, a jacket may be machined, molded, cast, printed, extruded, sintered, or compressed. A jacket may be pressed onto, or otherwise attached to, the cylindrical portion 102*a* and/or the conical portion 102*b*. A jacket may be subjected to post-processing after it has been attached to a projectile, such as hardening, acid treatment, or heat treatment, for example.

B.2 Round Edged Penetrator (REP)

With continued attention to FIG. 1, an example embodiment of an REP is referenced at 104. Except as noted hereafter, the size, materials, manufacturing, and configuration, of the REP 104 may be similar, or identical, to that of the SEP 102. As shown, the REP 104 may comprise a generally cylindrical portion 104*a*, and a rounded generally conical portion 104*b*. The cylindrical portion 104*a* and the conical portion 104*b* may be integral with each other and collectively formed of a single piece of material. The REP 104 may define a passageway 104*c* into, and/or through, which a wire and/or other components may extend/pass.

B.3 Double Edged Penetrator (DEP)

As further disclosed in FIG. 1, an example embodiment of an DEP is referenced at 106. Except as noted hereafter, the size, materials, manufacturing, and configuration, of the DEP 106 may be similar, or identical, to that of the SEP 102. As shown, the DEP 106 may comprise a generally cylindrical portion 106*a*, a first edge portion 106*b*, and a second edge portion 106*c*. The first edge portion 106*b* and the second edge portion 106*c* may abut each other, as shown. The first edge portion 106*b* and the second edge portion 106*c* may each comprise a surface, having a conical shape, inclined at a respective angle relative to an imaginary vertical Y-axis. The respective angles of inclination of those surfaces may be different from each other, as shown. The portion 106*a*, first edge portion 106*b*, and second edge portion 106*c* may be integral with each other and collectively formed of a single piece of material. The DEP 106 may define a passageway 106*d* into, and/or through, which a wire and/or other components may extend/pass.

B.4 Cutter Edged Penetrator (CEP)

As further disclosed in FIG. 1, an example embodiment of an CEP is referenced at 108. Except as noted hereafter, the size, materials, manufacturing, and configuration, of the CEP 108 may be similar, or identical, to that of the SEP 102. As shown, the CEP 108 may comprise a generally cylindrical portion 108*a*, and a generally conical portion 108*b*. In an embodiment, the maximum outside diameter of the generally conical portion 108*b* may be smaller than the outside diameter of the generally cylindrical portion 108*a*, so that a step is defined where the generally conical portion 108*b* and the generally cylindrical portion 108*a* meet.

The generally conical portion 108*b* and the generally cylindrical portion 108*a* may be integral with each other and collectively formed of a single piece of material. The CEP 108 may define a passageway 108*c* into, and/or through, which a wire and/or other components may extend/pass.

C. Example Embodiment of a Penetrator Assembly

Figure 2:
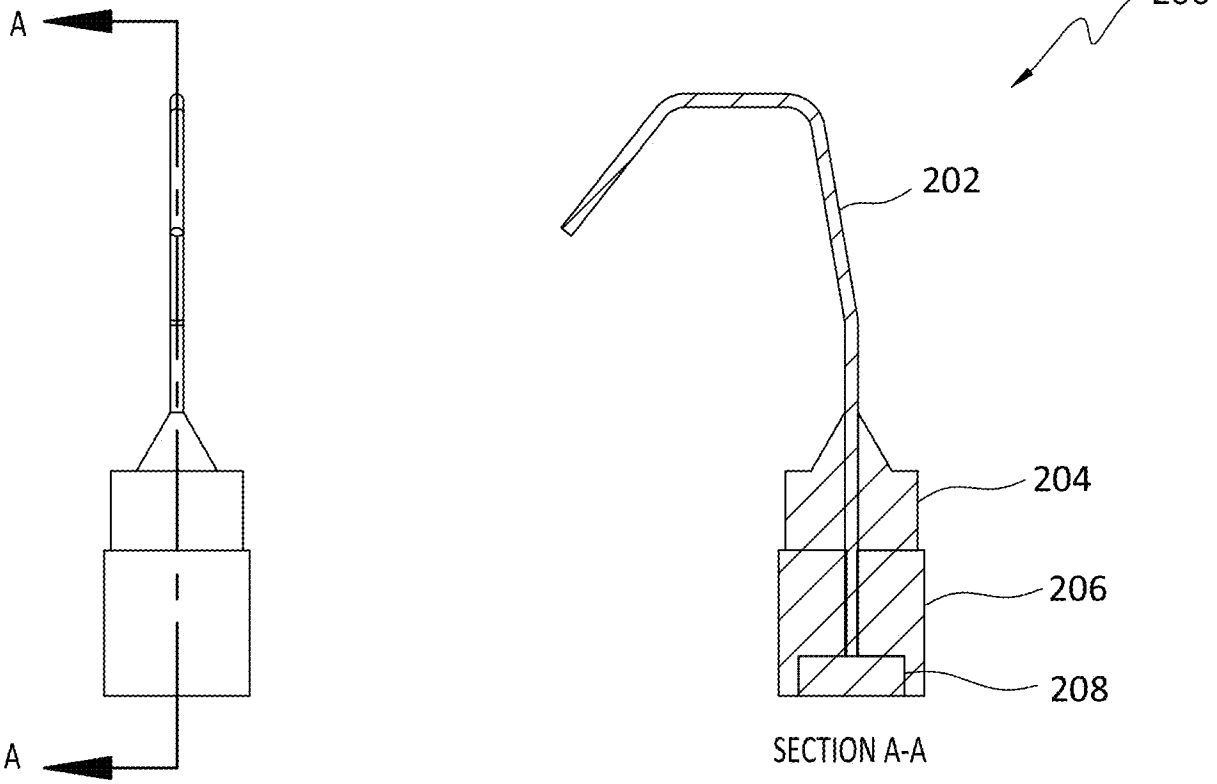
FIG. 2 discloses aspects of an example penetrator assembly.

Turning now to FIG. 2, an example penetrator assembly according to one example embodiment of the invention is referenced at 200. The example penetrator assembly 200 may comprise a primer wire 202, a penetrator 204, a propellant 206, and a primer 208.

The penetrator 204 may comprise any of the penetrators disclosed herein. In an embodiment, the penetrator 204 may be molded, or otherwise connected, to the propellant 206. In an embodiment, the penetrator 204 and propellant 206 may, or may not, be housed within a case, cartridge, or other housing. Thus, for example, in a caseless configuration of the penetrator 204 and propellant 206, there may be no cartridge or housing that would need to be expelled once the penetrator assembly 200 is fired. That is, the penetrator assembly 200 may be manufactured, and fired, without necessitating the use of a cartridge or casing to hold the penetrator 204 and propellant 206. In an embodiment, the penetrator 204 may have a solid form, or may define a passageway through which the primer wire 202 passes. Further details concerning the example primer wire 202 are set forth below.

In an embodiment, the primer wire 202 may be attached to a harness that connects to a connector which, in turn, may be connected to a bulkhead, or directly to a penetrator firing board. In an embodiment, the primer wire 202 may pass through the penetrator 204, such as by way of a passageway defined by the penetrator 204, and may also pass through the propellant 206, then connect to, and terminate at, the primer 208. In an embodiment, the primer wire 202 may be used, for example, to send command signals to the primer 208 to initiate the primer 208, which may then ignite the propellant 206.

With continued reference to the example of FIG. 2, the propellant 206 may comprise an energetic, munition, or explosive, that may withstand high temperatures, such as above 100 C for example, and high pressures, such as about 10K psi for example, without becoming unstable or prematurely detonating or burning. Example propellants 206 that may be employed in an embodiment of the invention include, but are not limited to, RDX (sometimes referred to as 'hexogen'), an organic compound with the formula $(O_2N_2CH_2)_3$, and HMX (sometimes referred to as 'octogen'), a nitroamine high explosive, chemically related to RDX. The propellant 206 may comprise a rapid burning propellant, or a slower controlled burning propellent.

In an embodiment, the propellant 206 may be in a powder form and be sculpted or molded to take a shape that enables the propellant 206 to conform to the geometry of the penetrator 204 and of a chamber (see FIG. 3) defined by a dispenser. In more detail, a conformable propellant 206 and relatively wide chamber may facilitate achievement of higher penetrator velocities. As well, an effective length of a barrel (see FIG. 3) defined by a dispenser may be increased due to the ability to shape, conform, and compress the propellant 206 into the propellant chamber so that the shape of the propellant 206 matches the geometry of the chamber interior, thereby reducing the amount of barrel space occupied by the propellant 206.

Finally, the primer 208 may be used to ignite the propellant 206 and may, in an embodiment, be contained within the propellant 206, as shown in FIG. 2. As noted earlier herein, the primer 208 may be initiated by, but not limited to, electrical signal command, various currents, or mechanical initiation.

D. Example Embodiment of a Chambered Penetrator Assembly

Figure 3:
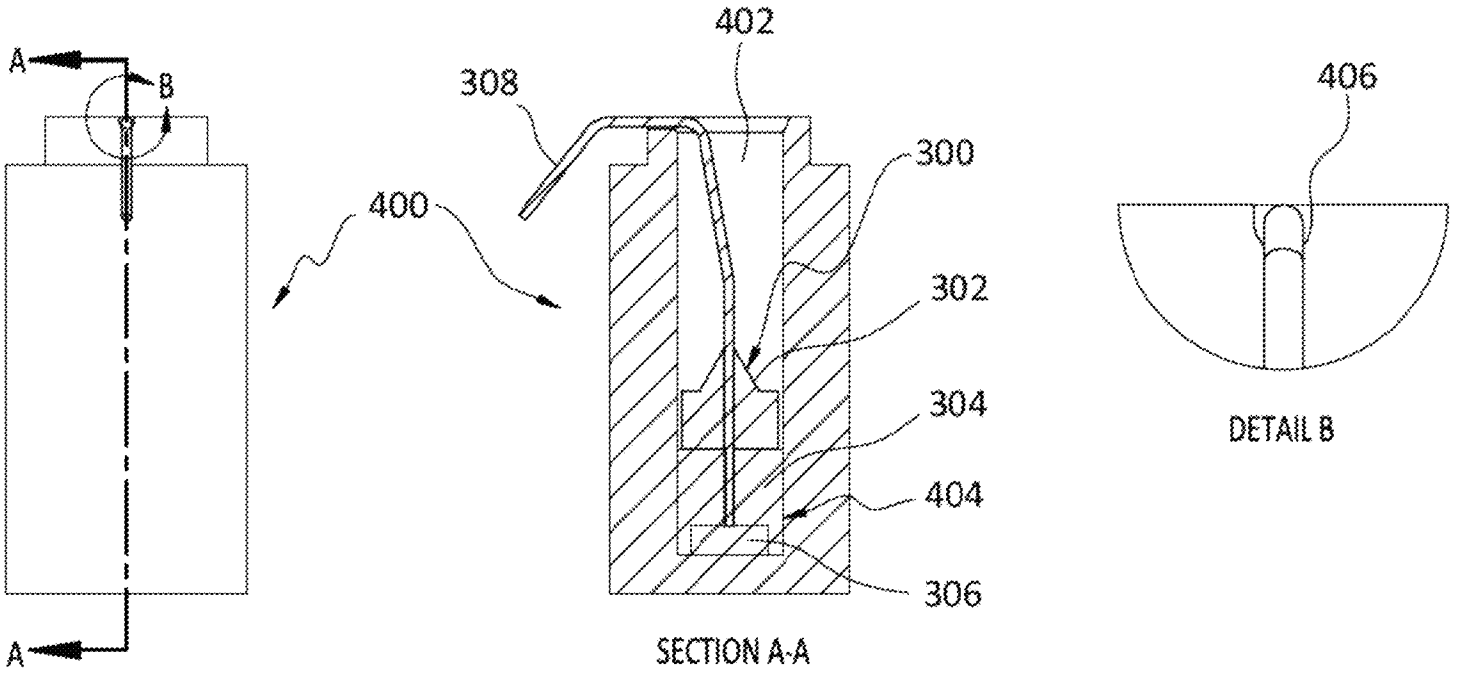
FIG. 3 discloses aspects of an example penetrator assembly.

With attention now to FIG. 3, an example penetrator assembly 300 is disclosed that chambered in a chamber 400 of a dispenser. In an embodiment, the penetrator assembly 300 may comprise any of the disclosed penetrator assemblies. Thus, the example penetrator assembly 300 may comprise a penetrator 302, propellant 304, and primer 306 to which a primer wire 308 may be connected.

In general, and as shown in FIG. 3, the penetrator assembly 300 may be chambered inside of a barrel 402 defined by a dispenser, where the penetrator assembly 300 may reside until it is dispensed, that is, until a penetrator of the penetrator assembly 300 is fired. Various methods may be used to place the penetrator assembly 300 in the barrel 402. For example, the penetrator assembly 300 may be placed pneumatically, hydraulically, or mechanically compressed, into the barrel 402. In an embodiment, the chamber 400 may comprise a housing, or block, that comprises one or more barrels 402.

In an embodiment, the barrel 402 may be sized and configured to house multiple penetrator assemblies 300 of the same, or different, sizes and lengths. The barrel 402 may be honed, machined, and/or otherwise manufactured, to enable optimal penetrator assembly 300 performance. The barrel 402 may be reloaded once, or many times, with another penetrator assembly 300, after dispensing a penetrator 302.

A propellant chamber 404 may be defined that communicates with the barrel 402. As shown in FIG. 3, the propellant chamber 404 may house the propellant 304 and the primer 306. In an embodiment, the base of the propellant chamber 404 may act as a tamper plate to ensure that the energy created when the propellant 304 is ignited is forced in the direction of the penetrator 302. This tamper plate may help to ensure that the barrel 402 remains within its dimensional tolerances after one or more penetrators 302 are dispensed through the barrel 402.

Finally, the example chamber 400 may comprise a wireway 406. In an embodiment, the wireway 406 may comprise a groove that may be machined, or otherwise created, at the top of the barrel 402 to enable primer the wire 308 to pass out of, without obstructing, the barrel 402 or chamber of the dispenser.

E. Example Embodiment of a Propellant Chamber

Figure 4:
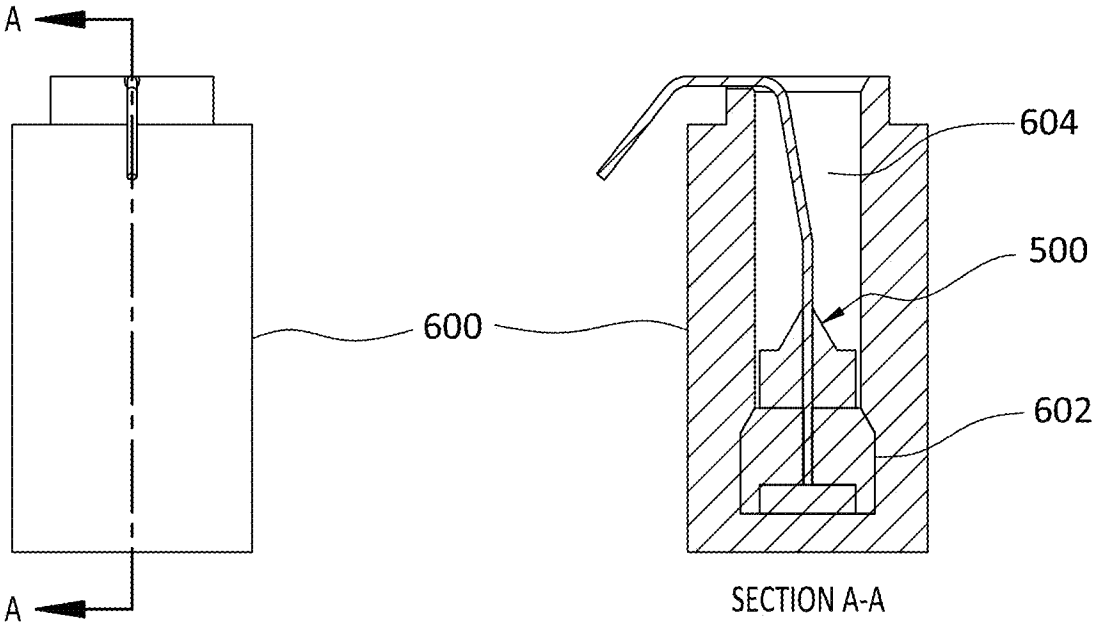
FIG. 4 discloses aspects of an example penetrator assembly.

With reference now to FIG. 4, and except as noted in the following discussion, the example penetrator assembly 500 and chamber 600 of FIG. 4 may be similar, or identical, to respectively, the example penetrator assembly 300 and the chamber 400.

As shown in FIG. 4, the example chamber 600 may comprise a propellant chamber 602. The propellant chamber 602 may house the propellant and the primer of the penetrator assembly 500. In an embodiment, the propellant chamber 602 may be sized and configured such that a portion of the propellant chamber 602 has a larger inside diameter than an inside diameter of a barrel 604 of the chamber 600. The relatively wider propellant chamber 602 may provide a relatively larger volume in which to compress more propellant. That is, the propellant chamber 602 may hold a larger volume of propellant or energetic than if the propellant chamber 602 had the same inside diameter as the barrel 604. This configuration of the propellant chamber 602 may enable the chamber 600 to employ a relatively longer barrel 604, so as to enable relatively higher velocities of penetrators fired out of the barrel 604.

F. Example Embodiment of a Dissolving Penetrator

Figure 5:
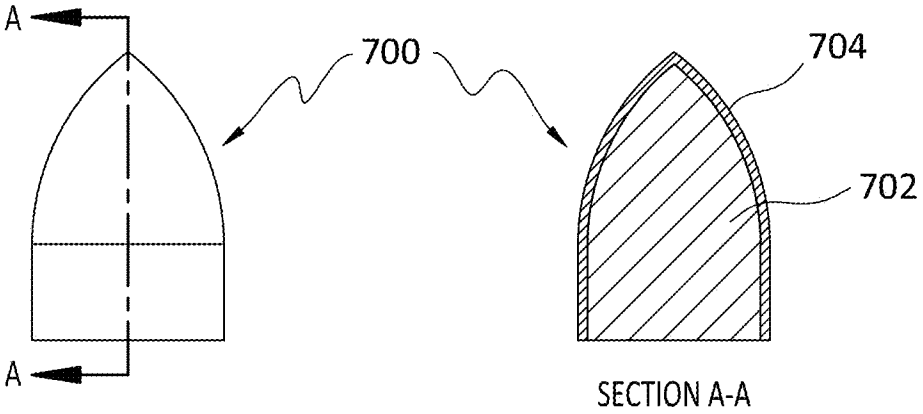
FIG. 5 discloses aspects of an example penetrator that includes a jacket.

Turning next to FIG. 5, an example embodiment of a dissolving penetrator is referenced at 700. In general, the example dissolving penetrator 700 may comprise a body 702 on which may be disposed a jacket 704. In an embodiment of the invention, the body 702 may comprise any of the penetrator materials disclosed herein.

In another embodiment of the invention, the body 702 may comprise, or consist of, a dissolving material such as dissolving alloy. The dissolving alloy may comprise, for example, magnesium, aluminum, or a combination of these. The dissolving material may be in a solid form and compressed into, or fitted to the inside of, the jacket 704. The dissolving material may also be poured into the jacket 704 and cured. The dissolving material may also be in powder form and be compressed to conform to the inside of the jacket 704. In an embodiment, the dissolving alloy(s) may be rendered into a molten state and poured into a mold and compressed to a desired shape, which may, or may not, be the shape of the body 702. In an embodiment, the dissolving alloy(s) may, after molding, be forged or sintered, for example, into the final shape, which may be the shape of the body 702. When the body 702 has been formed, the body 702 may then be jacketed, coated, or otherwise covered with the jacket 704 which may comprise, but is not limited to, tungsten, depleted uranium, steel, and nickel alloy jacket, or any combination of these.

In an embodiment, the dissolving material may dissolve, or begin dissolving, once the penetrator 700 is dispensed. In more detail, the dissolving material of the body 702 may begin to dissolve after the penetrator 700 has been dispensed and penetrated a casing, cement, and/or formation. The dissolving material of the body 702 will begin to break down after the body 702 has fragmented, such as after the penetrator 700 has penetrated the casing and/or other structures. That is, the penetrator 700 initially penetrates one or more elements after firing, then the penetrator 700 fragments, and the body 702 begins to break down and dissolve.

A penetrator 700 with a body 702 that is dissolvable may be desirable in some applications. For example, because the body 702 may break down after the penetrator 700 has been fired, the problem of having a solid penetrator fall back through the perforation into the wellbore may be avoided. Instead, the fragments of the penetrator 700 may remain in the formation and breakdown. The temperature and pressure in the downhole environment may help to may speed up the process of dissolution of the penetrator 700.

G. Example Operational Aspects of an Embodiment of the Invention

Figure 6:
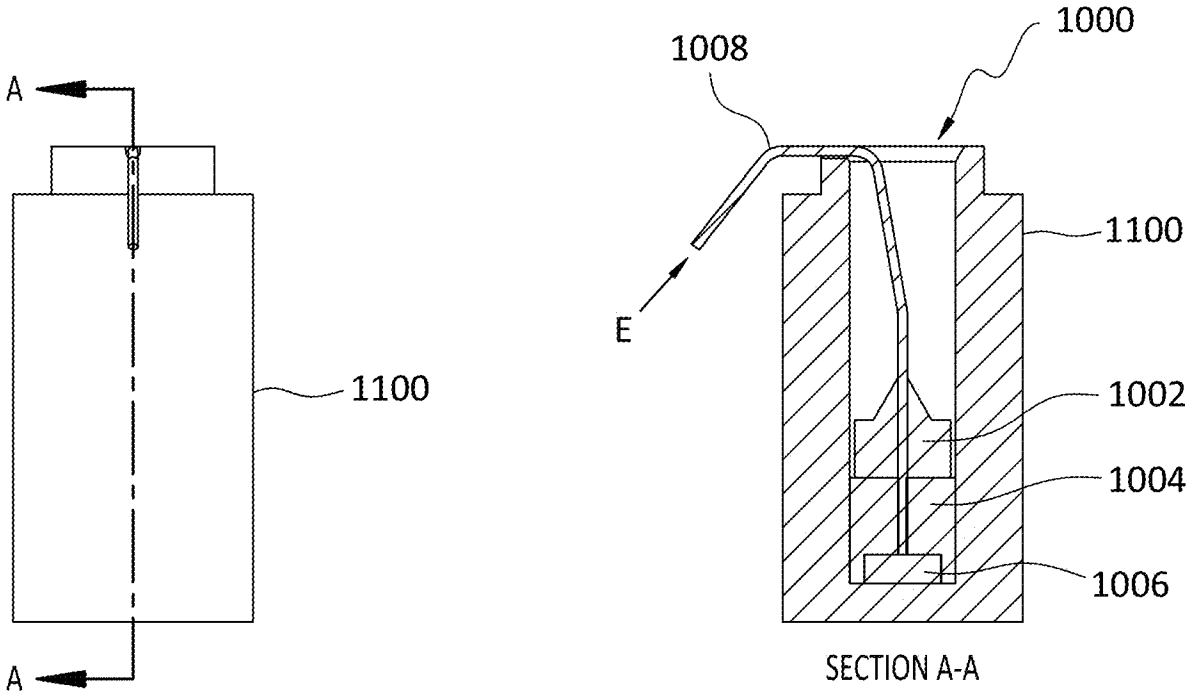
FIGS. 6, 7, 8, 9*a*, and 9*b*, disclose example operations, and associated structures and devices, in the firing of a penetrator assembly.

With attention now to FIGS. 6-9, details are provided concerning some operations aspects, including an ignition sequence, of an embodiment of the invention. With reference first to FIG. 6, an example penetrator assembly is referenced at 1000 and comprises a penetrator 1002, propellant 1004, primer 1006, and primer wire 1008. The penetrator assembly 1000 may be chambered in a chamber 1100 of a dispenser. In an embodiment, the dispenser may comprise multiple chambers 1100, each of which may hold a respective penetrator assembly 1000.

As shown in FIG. 6, an electrical signal 'E' may be transmitted, such as by a firing board for example, through the primer wire 1008 to initiate the primer 1006. In more detail, and with reference now to FIG. 7, the primer 1006 may be initiated upon its receipt of the electrical signal 'E.' In response to receipt of the electrical signal 'E,' the primer 1006 may ignite the propellant 1004. The ignition of the propellant 1004 may cause the propellant to burn, creating a gas 1008, or gases, which rapidly expands. The pressure created by the expanding gas 1008 acts on the penetrator 1002 to force the penetrator 1002 out of the barrel 1102 of the chamber 1100. This gas 1008 expansion may comprise a first gas expansion phase in the firing of the penetrator 1002.

Figure 7:
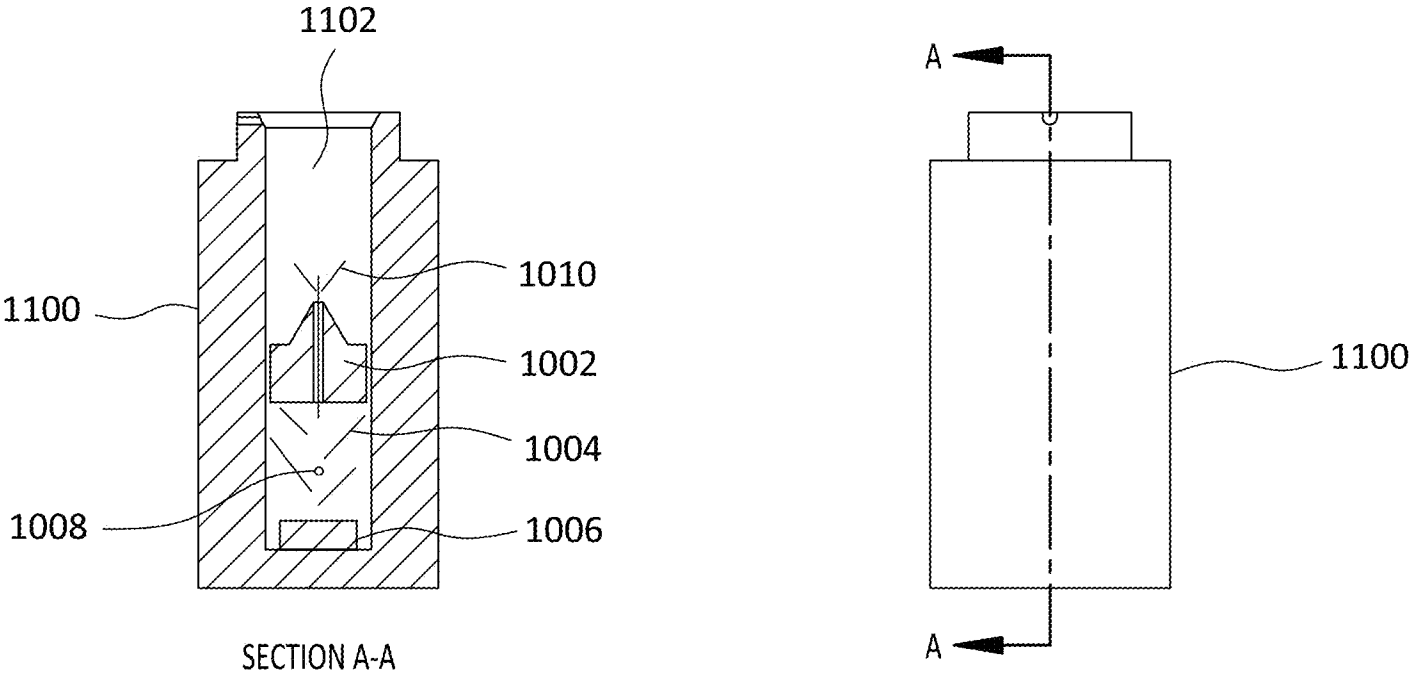

With continued reference to FIG. 7, the expanded gas, referenced at 1010, has expanded to the extent that it has pushed the primer wire 1008 out of the passageway defined by the penetrator 1002, so that some of the expanded gas is now able to pass through the passageway of the penetrator 1002 and out of the barrel 1102. As this expanded gas passes through the barrel 1102, the gas may displace any debris, fluid, or other material(s), that may be present in the barrel 1102.

Figure 8:
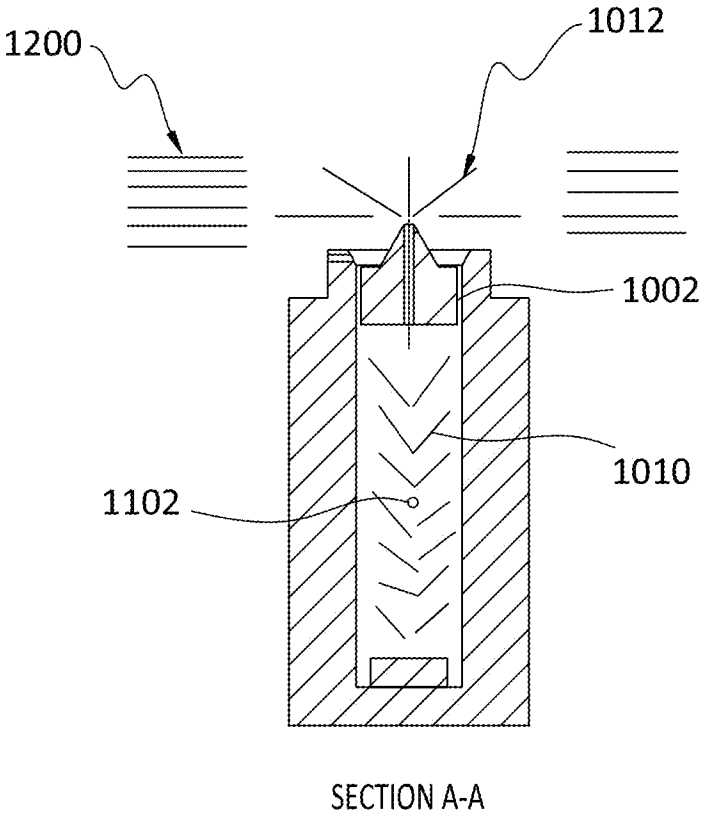
Figure 8:
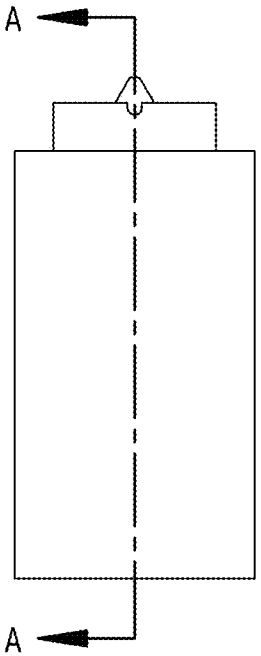

Turning next to FIG. 8, a second gas expansion phase is disclosed in which the gas 1010 has continued to expand, forcing, or dispensing, the penetrator 1002 out of the barrel 1102. As the gas 1010 continues to expand, the gas 1010 may exit the barrel 1102 and the expanded gas 1012 may displace any fluid(s), debris, and/or other material(s), collectively denoted at 1200, present between the penetrator 1002 and structures such as the wellbore, casing, and/or formation (see FIG. 9*a*). Thus, for example, the fluid 1200 may be forced away from the barrel 1102 by the gas 1012, resulting in the creation of a void that may then fill with gas/air that have been generated by the gas 1010 expansion through passageway of the penetrator 1002.

Figure 9A:
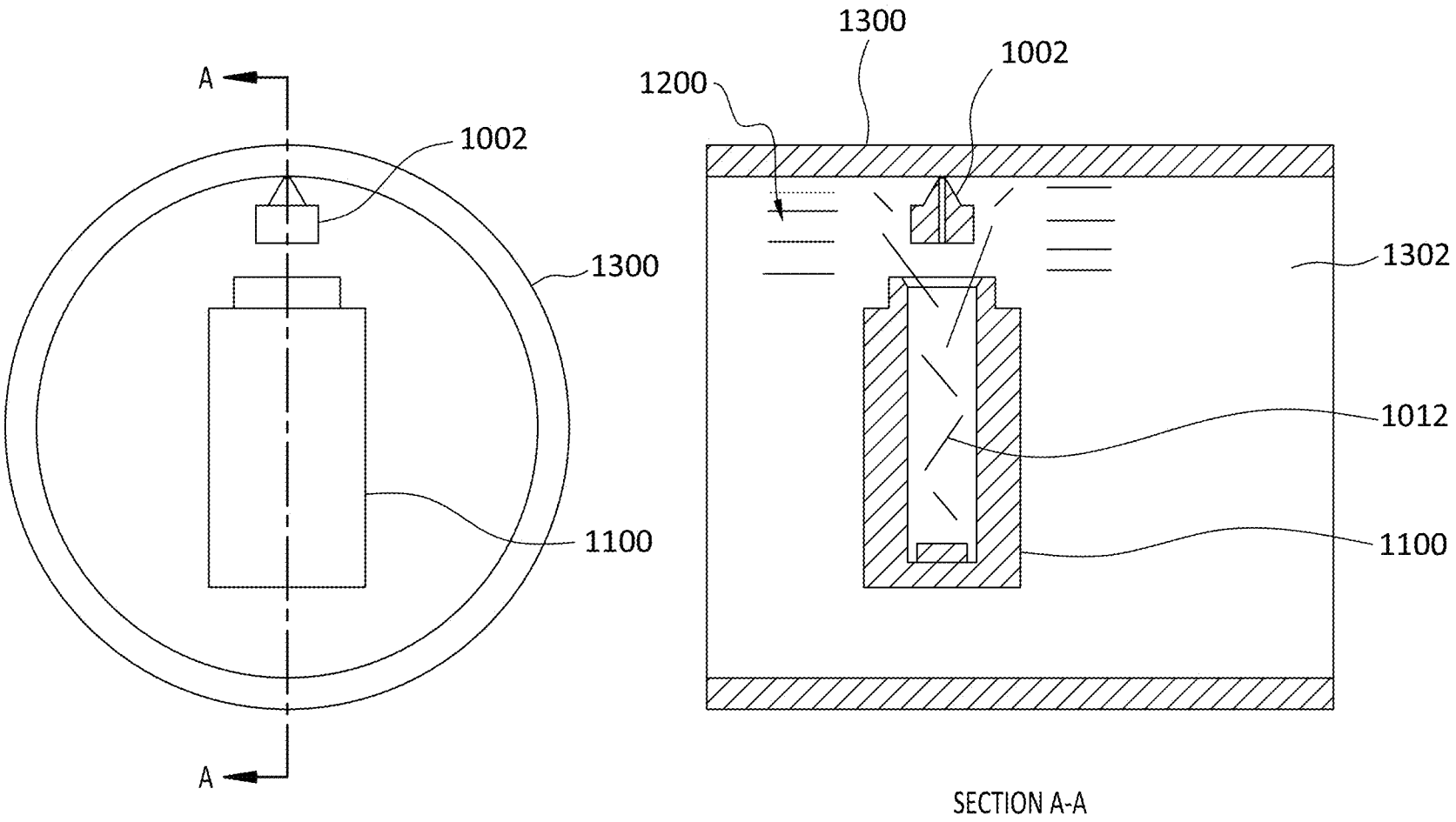

With reference now to FIG. 9*a*, the chamber 1100 of an example dispenser, having fired the penetrator 1002, is shown disposed within a wellbore casing 1300, or other downhole member, that defines an interior 1302. In particular, the propellant chamber and barrel of the chamber 1100 are now cleared, and expanding gas 1012 continues to force the penetrator 1002 into the wellbore casing 1300 so that the penetrator 1002 makes a hole or perforation in, and possibly through, the wellbore casing 1300.

As further indicated in FIG. 9*a*, the fluid 1200 has been displaced between the barrel of the chamber 1100 and the wellbore casing 1300 by the expansion of the gas 1012 through the penetrator 1002. As well, any residual gas generated inside of the barrel of the chamber 1100 after the penetrator 1002 has been completely dispensed out of the barrel, has also been displaced.

Figure 9B:
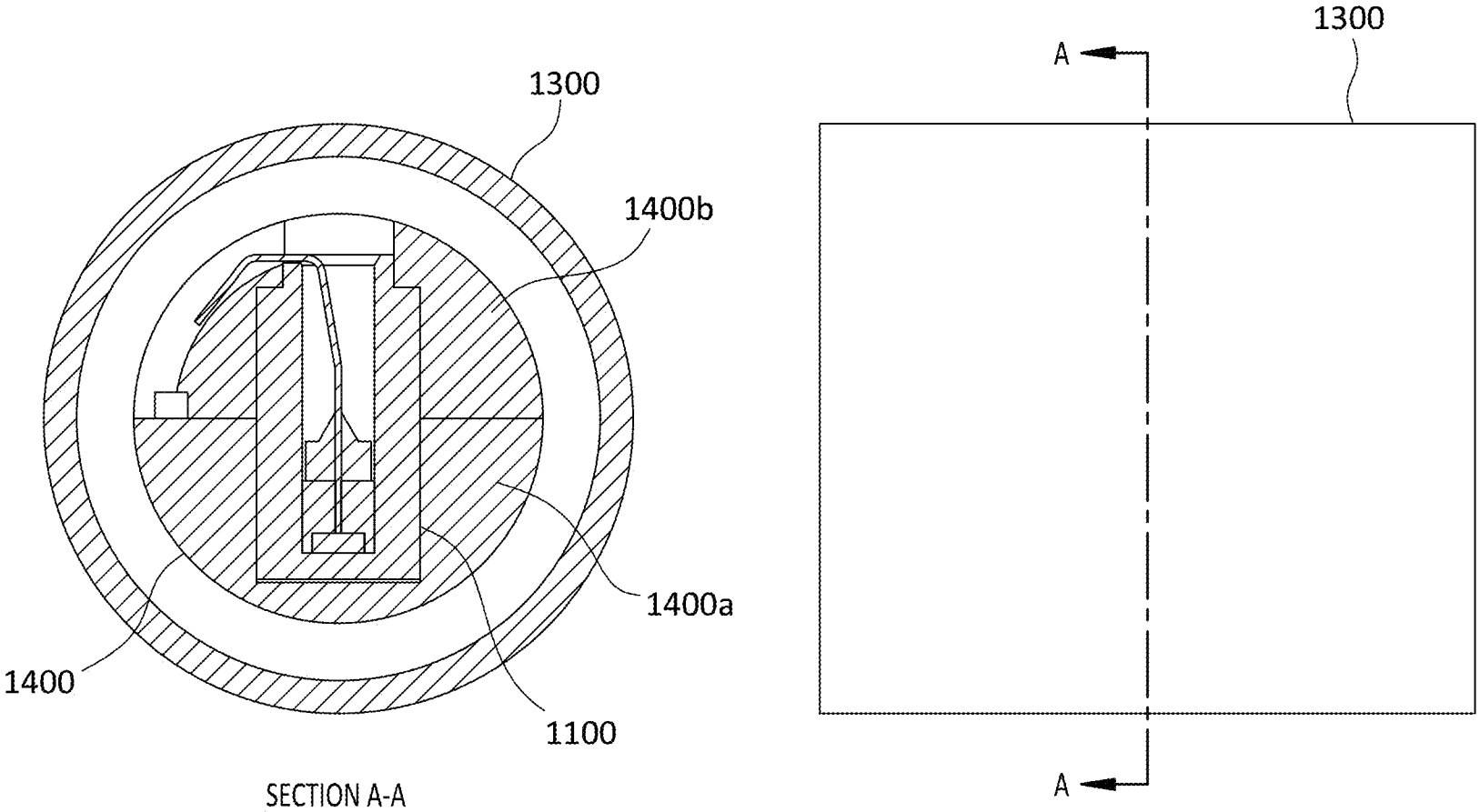

With reference briefly to FIG. 9*b*, a chamber 1100 of a dispenser is shown received in a carrier 1400 that is disposed in a casing 1300. The carrier 1400 may comprise any suitable structure(s), comprising one or more metals as disclosed herein, configured to receive one or more penetrator assemblies. In the example of FIG. 9*b*, the carrier 1400 comprises two halves 1400*a* and 1400*b* that are releasably connected together.

H. Further Aspects and Example Embodiments

Following are some further example aspects and embodiments of the invention. These are presented only by way of example and are not intended to limit the scope of the invention in any way.

Embodiment 1. A dispenser, comprising: a body that defines a chamber and a barrel that communicate with each other; and a penetrator assembly configured to be received in the chamber, and comprising: a penetrator; a propellant operably positioned with respect to the penetrator; a primer in operable communication with the propellant; and an electrical conductor configured and arranged to carry electrical power to the primer.

Embodiment 2. The dispenser as recited in any preceding embodiment, wherein the penetrator assembly is one of a group of individually deployable penetrator assemblies carried by the dispenser.

Embodiment 3. The dispenser as recited in any preceding embodiment, wherein the dispenser is sized and configured to fit within a well casing.

Embodiment 4. The dispenser as recited in any preceding embodiment, wherein the penetrator defines a passageway extending through the penetrator, and the electrical conductor passes through the passageway.

Embodiment 5. The dispenser as recited in any preceding embodiment, wherein the penetrator, electrical conductor, propellant, and the primer, are integrated together as a single unit.

Embodiment 6. The dispenser as recited in any preceding embodiment, wherein the electrical conductor comprises a wire passing through, or around, the penetrator.

Embodiment 7. The dispenser as recited in any preceding embodiment, wherein the propellant comprises a high explosive.

Embodiment 8. The dispenser as recited in any preceding embodiment, wherein the penetrator comprises a metal component that dissolves after being fired from the dispenser when the dispenser is positioned in a wellbore.

Embodiment 9. The dispenser as recited in any preceding embodiment, wherein when the penetrator assembly is fired, the penetrator passes through the barrel.

Embodiment 10. The dispenser as recited in any preceding embodiment, wherein the barrel is configured to removably receive the penetrator, and the barrel holds the penetrator in a position such that the penetrator can be fired radially into a wellbore casing when the dispenser is operably positioned in a wellbore.

Embodiment 11. The dispenser as recited in any preceding embodiment, wherein the propellant generates a gas when the propellant is burned.

Embodiment 12. The dispenser as recited in any preceding embodiment, wherein a portion of the chamber comprises a propellant chamber within which the propellant and the primer are disposed when the penetrator assembly is positioned in the dispenser.

Embodiment 13. The dispenser as recited in any preceding embodiment 2, wherein a geometry of the propellant conforms to an internal geometry of the propellant chamber.

Embodiment 14. The dispenser as recited in any preceding embodiment, wherein the dispenser defines a longitudinal axis that is generally concentric with an axis of a wellbore when the dispenser is disposed in the wellbore.

Embodiment 15. The dispenser as recited in any preceding embodiment, wherein the propellant generates a gas when the propellant is burned.

Embodiment 16. The dispenser as recited in any preceding embodiment, wherein the dispenser is configured to releasably connect to a perf gun.

Embodiment 17. The dispenser as recited in any preceding embodiment, wherein when the dispenser is positioned in a wellbore casing, and the penetrator is fired by ignition of the propellant, the penetrator passes out of the dispenser and part way through the wellbore casing.

Embodiment 18. The dispenser as recited in any preceding embodiment, wherein, in operation, the electrical conductor receives power and/or control signals from a firing board external to, or integrated within, the dispenser.

Embodiment 19. A penetrator assembly, comprising: a penetrator; a propellant operably positioned with respect to the penetrator; a primer in operable communication with the propellant; and an electrical conductor configured and arranged to carry electrical power to the primer, wherein the penetrator assembly is configured to be received in a chamber of a dispenser.

Embodiment 20. The penetrator assembly as recited in embodiment 19, wherein the penetrator is one of: a straight edged penetrator; a round edged penetrator; a cutter edged penetrator; and a double edged penetrator.

Embodiment 21. The penetrator assembly as recited in any of embodiments 19-20, wherein a first end of the electrical conductor passes is embedded into the propellant, and the electrical conductor passes through the penetrator and extends out an end of the penetrator.

Embodiment 22. The penetrator assembly as recited in any of embodiments 19-21, further comprising a jacket disposed about part of the penetrator.

Embodiment 23. The penetrator assembly as recited in any of embodiments 19-22, wherein the primer is embedded in the propellant.

Embodiment 24. A method for using the dispenser of any of embodiments 1-18.

Embodiment 25. A method for using the penetrator assembly of any of embodiments 19-23.

I. Example Computing Devices and Associated Media

The embodiments disclosed herein may include the use of a special purpose or general-purpose computer, which may comprise a firing board as disclosed herein, that includes various computer hardware or software modules, as discussed in greater detail below. A computer may include a processor and computer storage media carrying instructions that, when executed by the processor and/or caused to be executed by the processor, perform any one or more of the methods disclosed herein, or any part(s) of any method disclosed. In an embodiment, a computing system, comprising any of the components disclosed herein, may operate to control, such as through the use of a firing board, the firing of one or more penetrator assemblies.

As indicated above, embodiments within the scope of the present invention also include computer storage media, which are physical media for carrying or having computer-executable instructions or data structures stored thereon. Such computer storage media may be any available physical media that may be accessed by a general purpose or special purpose computer.

By way of example, and not limitation, such computer storage media may comprise hardware storage such as solid state disk/device (SSD), RAM, ROM, EEPROM, CD-ROM, flash memory, phase-change memory ("PCM"), or other optical disk storage, magnetic disk storage or other magnetic storage devices, or any other hardware storage devices which may be used to store program code in the form of computer-executable instructions or data structures, which may be accessed and executed by a general-purpose or special-purpose computer system to implement the disclosed functionality of the invention. Combinations of the above should also be included within the scope of computer storage media. Such media are also examples of non-transitory storage media, and non-transitory storage media also embraces cloud-based storage systems and structures, although the scope of the invention is not limited to these examples of non-transitory storage media.

Computer-executable instructions comprise, for example, instructions and data which, when executed, cause a general purpose computer, special purpose computer, or special purpose processing device to perform a certain function or group of functions such as, for example, the firing of one or more penetrator assemblies. As such, some embodiments of the invention may be downloadable to one or more systems or devices, for example, from a website, mesh topology, or other source. As well, the scope of the invention embraces any hardware system or device that comprises an instance of an application that comprises the disclosed executable instructions.

Although the subject matter has been described in language specific to structural features and/or methodological acts, it is to be understood that the subject matter defined in the appended claims is not necessarily limited to the specific features or acts described above. Rather, the specific features, operations, processes, and acts disclosed herein are disclosed as example forms of implementing the claims.

As used herein, the term 'module' or 'component' may refer to software objects or routines that execute on the computing system. The different components, modules, engines, and services described herein may be implemented as objects or processes that execute on the computing system, for example, as separate threads. While the system and methods described herein may be implemented in software, implementations in hardware or a combination of software and hardware are also possible and contemplated. In the present disclosure, a 'computing entity' may be any computing system as previously defined herein, or any module or combination of modules running on a computing system.

In at least some instances, a hardware processor is provided that is operable to carry out executable instructions for performing a method or process, such as the methods and processes disclosed herein. The hardware processor may or may not comprise an element of other hardware, such as, but not limited to, the computing devices, and other systems and components, disclosed herein.

In terms of computing environments, embodiments of the invention may be performed in client-server environments, whether network or local environments, or in any other suitable environment, such as a local computing environment at a wellsite for example. Suitable operating environments for some aspects of at least some embodiments of the invention include cloud computing environments where one or more of a client, server, or other machine may reside and operate in a cloud environment.

Figure 10:
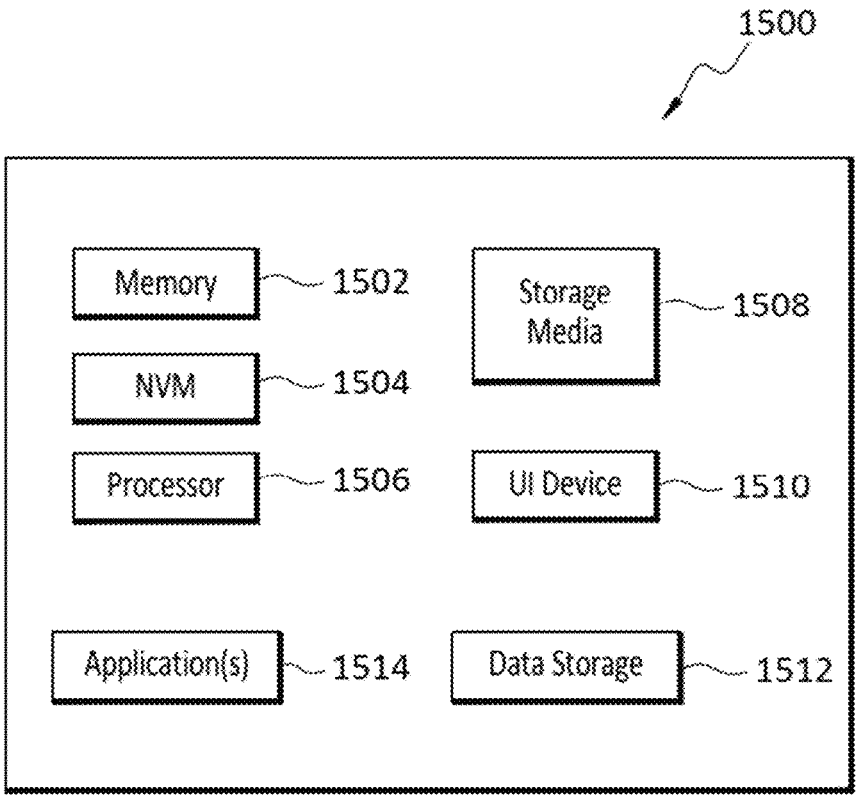
FIG. 10 discloses an example computing entity configured and operable to perform any of the disclosed computer-implemented methods, processes, and operations.

With reference briefly now to FIG. 10, any one or more of the entities disclosed, or implied, by FIGS. 1-9 and/or elsewhere herein, may take the form of, or include, or be implemented on, or hosted by, a physical computing device, one example of which is denoted at 1500.

In the example of FIG. 10, the physical computing device 1500 includes a memory 1502 which may include one, some, or all, of random access memory (RAM), non-volatile memory (NVM) 1504 such as NVRAM for example, read-only memory (ROM), and persistent memory, one or more hardware processors 1506, non-transitory storage media 1508, UI (user interface) device 1510, and data storage 1512. One or more of the memory components 1502 of the physical computing device 1500 may take the form of solid state device (SSD) storage. As well, one or more applications 1514 may be provided that comprise instructions executable by one or more hardware processors 1506, such as GPUs (graphics processing unit) for example, to perform any of the operations, or portions thereof, disclosed herein.

Such executable instructions may take various forms including, for example, instructions executable to perform any method or portion thereof disclosed herein, and/or executable by/at any of a storage site, whether on-premises at an enterprise, or a cloud computing site, client, datacenter, data protection site including a cloud storage site, or backup server, to perform any of the functions disclosed herein. As well, such instructions may be executable to perform any of the other operations and methods, and any portions thereof, disclosed herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A penetrator assembly, comprising:

a penetrator;

a propellant operably positioned with respect to the penetrator;

an ignitor in operable communication with the propellant; and an electrical conductor configured and arranged to carry electrical power to a primer, and a first end of the electrical conductor is embedded into the propellant, and the electrical conductor passes through, or around, the penetrator.

2. The penetrator assembly as recited in claim 1, wherein the propellant comprises a conformable material that has been sculpted or molded to conform to a geometry of a propellant chamber that holds the propellant.

3. The penetrator assembly as recited in claim 1, further comprising a jacket disposed on the penetrator.

4. The penetrator assembly as recited in claim 1, wherein the penetrator comprises a dissolving penetrator.

5. The penetrator assembly as recited in claim 1, wherein the penetrator comprises a dissolving penetrator, and a jacket is disposed on the penetrator.

6. The penetrator assembly as recited in claim 1, wherein the penetrator comprises a round edged penetrator (REP) that terminates at one end in a rounded conical configuration.

7. The penetrator assembly as recited in claim 1, wherein the penetrator and the propellant together comprise a caseless configuration.

8. The penetrator assembly as recited in claim 1, wherein the penetrator is configured such that, when the penetrator assembly is fired, the penetrator creates a hole, in a target, that is elliptically shaped, round, or wedge-shaped.

9. The penetrator assembly as recited in claim 1, wherein the electrical conductor is directly connectible to a penetrator firing board that is operable to control operation of the ignitor.

10. The penetrator assembly as recited in claim 1, wherein the penetrator comprises one of: a straight edged penetrator (SEP); a double edged penetrator (DEP); or, a cutter edged penetrator (CEP).

11. The penetrator assembly as recited in claim 1, wherein the penetrator defines a passageway that extends completely through the penetrator.

12. The penetrator assembly as recited in claim 1, wherein the propellant comprises one of: an energetic; a munition; or, an explosive.

13. The penetrator assembly as recited in claim 1, wherein the penetrator comprises one or more materials selected from a group comprising: tungsten alloys including tungsten combined with one or more of copper, cobalt, nickel, iron, and chromium; molybdenum tungsten; niobium tungsten; vanadium tungsten; cemented carbide or tungsten carbide; and, depleted uranium; uranium 238; steel; titanium; antimony; zinc; tin; copper; lead; rhenium; platinum; iridium; and, osmium.

14. A dispenser, comprising:

a body comprising a chamber, and the body is configured to be removably received in a carrier;

a barrel defined within, and integral with, the chamber, and the barrel is configured to receive a penetrator assembly; and a wireway defined by the chamber and configured to enable insertion of an electrical conductor into the barrel, and the wireway is configured and arranged to enable insertion of the electrical conductor into an open end of the barrel.

15. The dispenser as recited in claim 14, wherein the chamber comprises a block that comprises one or more barrels, and each of the barrels is configured to receive one or more penetrators.

16. The dispenser as recited in claim 14, wherein the dispenser comprises a perforation gun.

17. The dispenser as recited in claim 14, wherein the dispenser is integrated into a perf gun.

18. The dispenser as recited in claim 14, wherein the dispenser is configured to be removably received in a perf gun.

19. The dispenser as recited in claim 14, wherein the dispenser is reusable after a penetrator of a penetrator assembly has been fired from the barrel.

20. The dispenser as recited in claim 14, wherein the barrel is configured to removably receive a penetrator assembly that comprises a penetrator whose length is in a range of 0.5 inches to 1.00 inches.

21. The dispenser as recited in claim 14, wherein when the dispenser is positioned in a downhole location, an interior of the barrel is open to environmental conditions in the downhole environment.

22. The dispenser as recited in claim 14, wherein the dispenser includes the electrical conductor.

23. The dispenser as recited in claim 14, wherein a firing board is integrated into the dispenser and is configured to connect to an electrical conductor.

24. A carrier, comprising:

a body having a configuration that comprises a bottom half and a top half that are releasably connectible together; and a receptacle defined within the body and configured to removably receive a dispenser and a penetrator assembly, and respective portions of the receptacle are defined by the bottom half of the body, and the top half of the body.

25. The carrier as recited in claim 24, wherein a longitudinal axis defined by the body is perpendicular to a longitudinal axis of the receptacle.

26. The carrier as recited in claim 24, wherein the top half of the body comprises a geometric feature configured to interact with a corresponding geometric feature of a penetrator assembly to retain a penetrator assembly in the receptacle.

27. The carrier as recited in claim 24, wherein the body defines an opening configured and arranged to align with a barrel of a penetrator assembly when the penetrator assembly is disposed within the receptacle.

28. The carrier as recited in claim 24, wherein a seam defined by the top half and the bottom half is perpendicular to a longitudinal axis of the receptacle.

29. An apparatus, comprising:

a penetrator assembly, comprising:

a penetrator;

a propellant operably positioned with respect to the penetrator;

an ignitor in operable communication with the propellant; and an electrical conductor configured and arranged to carry electrical power to a primer, and a first end of the electrical conductor is embedded into the propellant, and the electrical conductor passes through, or around, the penetrator;

a dispenser configured to removably receive the penetrator assembly; and a carrier configured to removably receive the dispenser.

30. The apparatus as recited in claim 29, wherein the dispenser is reusable after the penetrator of the penetrator assembly has been fired from the barrel.

31. The apparatus as recited in claim 29, wherein the carrier comprises a body having a bottom half and a top half that are releasably connectible together, and a receptacle is defined within the body and is configured to removably receive the penetrator assembly.

32. The apparatus as recited in claim 29, wherein the penetrator and the propellant together comprise a caseless configuration.

33. The apparatus as recited in claim 29, wherein the dispenser comprises a barrel defined within, and integral with, a chamber of the dispenser, and the barrel is configured to removably receive the penetrator assembly.

* * * * *